US012071828B2

(12) United States Patent
Merrick

(10) Patent No.: US 12,071,828 B2
(45) Date of Patent: Aug. 27, 2024

(54) SUBSEA TREE INCLUDING A FLUID SWIVEL

(71) Applicant: Pivotree Pty Ltd, Nedlands (AU)

(72) Inventor: Christopher Merrick, Wembley Downs (AU)

(73) Assignee: Pivotree Pty Ltd, Nedlands (AU)

( * ) Notice: Subject to any disclaimer, the term of this patent is extended or adjusted under 35 U.S.C. 154(b) by 0 days.

(21) Appl. No.: 18/007,325

(22) PCT Filed: Aug. 12, 2020

(86) PCT No.: PCT/AU2020/050842
§ 371 (c)(1),
(2) Date: Jan. 30, 2023

(87) PCT Pub. No.: WO2021/026610
PCT Pub. Date: Feb. 18, 2021

(65) Prior Publication Data

US 2023/0265729 A1 Aug. 24, 2023

(30) Foreign Application Priority Data

Aug. 12, 2019 (AU) ..... 2019902895

(51) Int. Cl.
*E21B 33/035* (2006.01)
*E21B 17/05* (2006.01)
*E21B 34/04* (2006.01)

(52) U.S. Cl.
CPC ..... *E21B 33/0355* (2013.01); *E21B 17/05* (2013.01); *E21B 34/045* (2013.01)

(58) Field of Classification Search
CPC .... E21B 33/0355; E21B 17/05; E21B 34/045; E21B 33/035; E21B 43/121; E21B 17/01;
(Continued)

(56) References Cited

U.S. PATENT DOCUMENTS 6,209,650 B1 * 4/2001 Ingebrigtsen ..... E21B 43/0135 166/368
11,306,557 B2 * 4/2022 Murphy ..... E21B 33/035
2013/0264065 A1 * 10/2013 Robichaux ..... E21B 17/1064 166/381

FOREIGN PATENT DOCUMENTS

EP 3460170 3/2019
WO WO-9502146 A1 * 1/1995 ..... F16L 27/087
(Continued)

OTHER PUBLICATIONS

International Search Report received in PCT/AU2020/050842 mailed Sep. 2, 2020.

(Continued)

*Primary Examiner* — James G Sayre
(74) *Attorney, Agent, or Firm* — Suzannah K. Sundby, Esq.; Canady + Lortz LLP

(57) ABSTRACT

A subsea tree including a fluid swivel, the fluid swivel comprising: (a) a fixed inner body defining an inlet for fluid communication with a production conduit fora subsea well; (b) a rotatable outer body defining an outlet and an attachment point for fluid communication with a riser; (c) a first interface between the fixed inner body and the rotatable outer body defining a fluid chamber in fluid communication with the inlet and the outlet; and (d) a first seal between the fixed inner body and the rotatable outer body; wherein, when the fluid swivel is attached to the riser, the riser is capable of rotational movement around the subsea tree.

23 Claims, 5 Drawing Sheets

(58) Field of Classification Search
CPC ..... E21B 33/076; E21B 43/013; E21B 43/01; B63B 27/34
See application file for complete search history.

(56) References Cited

FOREIGN PATENT DOCUMENTS

| | | | |
|---|---|---|---|
| WO | 9809050 | 3/1998 | |
| WO | 9809052 | 3/1998 | |
| WO | WO-9809051 A1 * | 3/1998 | ..... B63B 21/50 |
| WO | 2004059119 | 7/2004 | |

OTHER PUBLICATIONS

Written Opinion received in PCT/AU2020/050842 mailed Sep. 2, 2020.
Swivel and Marine Systems, 2018, pp. 1-16, Publisher: ONESUBSEA, https://www.onesubsea.slb.com/-/media/pnesubsea/files/brochure/oss-swivel-and-marine-br.ashx.

* cited by examiner

SUBSEA TREE INCLUDING A FLUID SWIVEL

FIELD OF THE INVENTION

The present invention relates to a subsea tree including a fluid swivel. The present invention also relates to a system for harvesting a hydrocarbon from a subsea well as well as a method for attaching a vessel to a subsea tree.

BACKGROUND TO THE INVENTION

The cost of current solutions for exploiting natural resources in the oil and gas sector means that many smaller scale oil and gas fields cannot be developed economically.

The present invention seeks to provide an improved subsea tree assembly solution that will safely enable the commercialisation of smaller scale oil and gas fields by allowing for a well to be produced without many of the components that are traditionally required. At the very least the present invention seeks to provide an alternative to current solutions for controlling and harvesting oil and gas natural resources.

SUMMARY OF THE INVENTION

The present invention provides a subsea tree including a fluid swivel, the fluid swivel comprising:

(a) a fixed inner body defining an inlet for fluid communication with a production conduit for a subsea well;
(b) a rotatable outer body defining an outlet and an attachment point for fluid communication with a riser;
(c) a first interface between the fixed inner body and the rotatable outer body defining a fluid chamber in fluid communication with the inlet and the outlet; and
(d) a first seal between the fixed inner body and the rotatable outer body;

wherein, when the fluid swivel is attached to the riser, the riser is capable of rotational movement around the subsea tree.

In accordance with a second aspect of the present invention, there is provided a system for harvesting a hydrocarbon from a subsea well, the system comprising:

(a) a subsea tree according to a first aspect of the present invention, including a fluid swivel, and being operably connected to the subsea well;
(b) a surface vessel for harvesting the hydrocarbon; and
(c) a riser having a first and a second end, said first end attached to and in fluid communication with the fluid swivel, and said second end attached to and in fluid communication with the surface vessel;

wherein, in use, the surface vessel is capable of rotational movement around the subsea well.

In accordance with a third aspect of the present invention, there is provided a method for attaching a vessel to a subsea tree of a subsea well, the method comprising:

(a) providing a subsea tree according to a first aspect of the present invention including a fluid swivel;
(b) providing a riser having first and second ends;
(c) attaching the first end of the riser to the fluid swivel; and
(d) attaching a second end of the riser to the vessel;

wherein, when the riser is attached to the fluid swivel and the vessel, the vessel is capable of rotational movement around the subsea well.

It is to be recognised that other aspects, preferred forms and advantages of the present invention will be apparent from the specification including the detailed description, examples, drawings and claims provided below.

BRIEF DESCRIPTION OF DRAWINGS

In order to facilitate a better understanding of the present invention, preferred embodiments are described herein with reference to the accompanying drawings, in which.

DETAILED DESCRIPTION OF THE INVENTION

Figure 1:
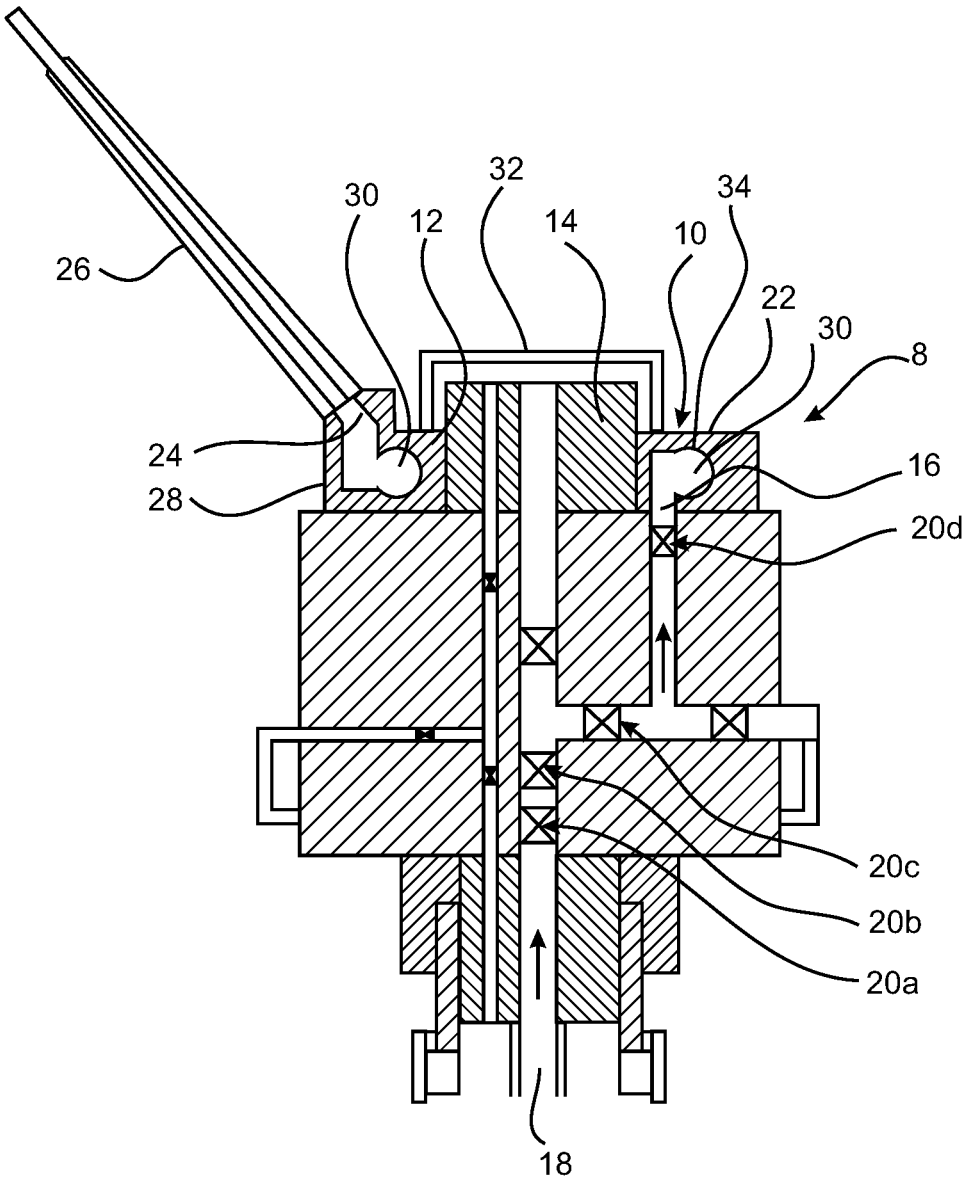
FIG. 1 is a cross sectional view of part of a subsea tree including a fluid swivel according to one embodiment of the first aspect of the present invention.

According to a first aspect of the present invention, there is provided a subsea tree including a fluid swivel, the fluid swivel comprising:

(a) a fixed inner body defining an inlet for fluid communication with a production conduit for a subsea well;
(b) a rotatable outer body defining an outlet for fluid communication with a riser and an attachment point for the riser;
(c) a first interface between the fixed inner body and the rotatable outer body defining a fluid chamber in fluid communication with the inlet and the outlet; and
(d) a first seal between the fixed inner body and the rotatable outer body;

wherein, when the fluid swivel is attached to the riser, the riser is capable of rotational movement around the subsea tree.

Preferably, the term "subsea tree" as used herein refers to a subsea flow controller such as a subsea Christmas tree or Christmas/xmas tree.

Preferably, the fluid swivel is mounted to an upper portion of the subsea tree.

Preferably, the fluid swivel extends upwards from an upper portion of the subsea tree.

Preferably, the fluid swivel extends upwards from an upper surface of the subsea tree.

Preferably the fluid swivel is operable by hydraulic power. For example, one or more seals in the fluid swivel may be hydraulically operable.

Preferably, the subsea tree further comprises a mandrel and the fluid swivel is mounted to at least partially surround the mandrel. Preferably, the mandrel is an upper mandrel such as a mandrel located at or near the top portion of the subsea tree.

Preferably, the fixed inner body is fixed relative to the subsea tree.

Preferably, the fixed inner body defines an inner aperture for receiving another part of the subsea tree such as a mandrel. Such an aperture may assist with mounting the fluid swivel to the subsea tree.

Preferably, the inner aperture is a hollow or recess.

Preferably, the inner aperture may comprise a bore or lumen.

Preferably, the fixed inner body is generally ring shaped.

Preferably, the fixed inner body is generally cylindrical in shape.

Preferably, the fixed inner body is generally cone shaped. When the fixed inner body is generally cone shaped it preferably tapers in towards its lower end, when in use. Even more preferably, the fixed inner body is a blunt ended cone shape.

Preferably, the angle of the taper is about 30-60° such as about 40°, 45° or 50°.

Preferably, the inlet for fluid communication with a production conduit for a subsea well is located at the lower end of the fixed inner body.

Preferably, the rotatable outer body is rotatable relative to the fixed inner body.

Preferably, the rotatable outer body rotates on the fixed inner body.

Preferably, the rotatable outer body rotates around the fixed inner body.

Preferably, the rotatable outer body is generally ring shaped.

Preferably, the shape of the rotatable outer body is shaped to match the shape of the fixed inner body such that the fixed inner body can nest in the rotatable outer body. For example, when the fixed inner body is generally cone shaped and tapers in towards its lower end, when in use, the rotatable outer body will define a tapered surface compatible with a tapered surface defined on the fixed inner body.

Preferably, the outlet for fluid communication with a riser is located on the outer surface of the rotatable outer body.

Preferably, the attachment point for the riser is located adjacent to the outlet for the fluid communication the riser.

Preferably, the attachment point for the riser defines a connection means for the riser.

The attachment point for the riser allows for the fluid swivel to be attached to a riser that is in turn attached to a vessel on the sea surface and allow for the vessel to weather vane whilst attached to the subsea tree.

Preferably, the first interface is the point of contact between the fixed inner body and the rotatable outer body.

Preferably, the first interface comprises a point or surface where the rotatable outer body bears on the fixed inner body.

Preferably, the first interface comprises a bearing. Even more preferably the first interface comprises a plurality of bearings.

Preferably, the fluid chamber is defined by at least part by the opposed faces of the fixed inner body and the rotatable outer body.

Preferably, the fluid chamber has a generally circular or oval cross section.

Preferably, the fluid chamber defines a circular flow path.

Preferably, the first seal comprises a seal member. Even more preferably, the first seal comprises a plurality seal members.

Preferably, each seal member is located between two bearings.

The subsea tree may further comprise a hydraulic power unit (HPU). Preferably the HPU is removable.

The subsea tree may further comprise at least one hydraulic reservoir.

Preferably, the hydraulic reservoir is in fluid communication with at least one of the bearings in the subsea tree.

Preferably, the hydraulic reservoir comprises at least one inlet, for receiving hydraulic fluid. Preferably, the inlet is adapted to be operable by a remotely operated vehicle (ROV)

Preferably, the subsea tree further comprises a subsea control module. Preferably the subsea control module is removable.

Preferably, the subsea tree further comprises at least one injection valve such as a chemical injection valve for receiving a chemical for use in the subsea tree. The chemical can be varied an includes any chemical for manipulating fluid flow in the subsea tree. These include chemicals for addressing corrosion, scale, wax and hydrates. Examples of chemicals include but are not limited to scale inhibitors (e.g. acrylic acid polymers, maleic acid polymers, phosphates), corrosion inhibitors, methanol and mono-ethylene glycol (MEG).

The subsea tree may further comprise at least one chemical reservoir. Preferably the at least one chemical reservoir comprises at least one outlet in fluid communication with at least one chemical injection valve, and at least one inlet for receiving fluid input. Preferably the inlet is operably compatible with a ROV.

Preferably, the pressure of the at least one chemical storage reservoir is maintained by the HPU.

Preferably, the subsea tree comprises one or more ports adapted to control the transfer of hydraulic fluids, chemicals and/or electrical services to the subsea tree.

Preferably, the subsea tree further comprises one or more flow control valve(s). Preferably, the one or more flow control valves are adapted to be operated manually, remotely, or a combination of both.

Preferably, the subsea tree further comprises one or more injection valves. Preferably the one or more injection valves are adapted to provide one or more chemicals to the subsea tree. Preferably the one or more injection valves are adapted to be controlled remotely.

In accordance with a second aspect of the present invention, there is provided a system for harvesting a hydrocarbon from a subsea well, the system comprising:

(a) a subsea tree according to a first aspect of the present invention, including a fluid swivel, and being operably connected to the subsea well;
(b) a surface vessel for harvesting the hydrocarbon; and
(c) a riser having a first and a second end, said first end attached to and in fluid communication with the fluid swivel, and said second end attached to and in fluid communication with the surface vessel;

wherein, in use, the surface vessel is capable of rotational movement around the subsea well.

Preferably the surface vessel is a harvesting vessel.

Preferably, the surface vessel is adapted to control the subsea tree.

Preferably, the surface vessel provides a power source for the subsea tree via a control cable located therebetween.

Preferably, the surface vessel does not include a swivel assembly such as a swivel assembly turret or swivel stack.

Preferably, the system further comprises a mooring assembly for attaching the surface vessel to the subsea well wherein the mooring assembly is adapted for rotational movement around the subsea well. Even more preferably, the mooring assembly is adapted to rotate 360 degrees around the subsea well.

Preferably, the mooring assembly is located at or near the interface between the subsea well and the subsea ground surface.

Preferably, the mooring assembly comprises a housing for a well conductor.

The integration of the fluid swivel, hydraulic power, chemical reservoirs and control system components into the subsea tree negates the need for the surface vessel to house these features, and, means a wider range of surface vessels can be used in the hydrocarbon production using the apparatus of the present invention including vessels without a rotating or swivelling production turret.

The surface vessel may comprise surface separation and processing facilities. The separation and processing facilities may be modular and transportable and interconnected with either rigid or flexible pipework.

Preferably, the surface vessel includes at least one engine adapted to run on compressed natural gas. For example, the surface vessel may comprise a gas engine power generator. Preferably the gas engine power engine utilises a portion of the one or more hydrocarbon products from the well being harvested. Preferably the surface vessel has the facility to store compressed natural gas on deck in pressurised containers.

It will be appreciated that the system of the present invention allows for the riser to rotate around the subsea tree while connected to the surface vessel, said rotational movement corresponding to weather vaning of the surface vessel. When fitted, the surface vessel may also be anchored to the subsea well via an attachment point for a mooring line, also allowing weather vaning of the surface vessel. Preferably, the surface vessel comprises a thruster for maintaining constant tension on the mooring/anchor.

Preferably, the second end of the riser connects to a loading inlet on the surface vessel. Even more preferably the second end of the riser connects to the surface vessel via a coupling means. The coupling means may include an emergency break away coupling. Preferably, the riser is capable of being controllably disconnected from the surface vessel when required such as in response to one or more of (i) a production tank of the surface vessel being at capacity; and/or (ii) an extreme weather event.

Preferably the system further comprises a remotely operated vehicle ("ROV"). Preferably the ROV is capable of performing at least one function selected from the group consisting of: providing a fluid input or supply to the at least on storage reservoir; actuating at least one control valve and actuating at least one injection valve.

In accordance with a third aspect of the present invention, there is provided a method for attaching a vessel to a subsea tree of a subsea well, the method comprising:

(a) providing a subsea tree according to a first aspect of the present invention including a fluid swivel;

(b) providing a riser having first and second ends;

(c) attaching the first end of the riser to the fluid swivel; and (d) attaching a second end of the riser to the vessel wherein, when the riser is attached to the fluid swivel and the vessel, the vessel is capable of rotational movement around the subsea well.

Preferably, the method further comprises the step of harvesting hydrocarbons from the subsea well.

General

Those skilled in the art will appreciate that the invention described herein is susceptible to variations and modifications other than those specifically described. The invention includes all such variation and modifications. The invention also includes all of the steps and features referred to or indicated in the specification, individually or collectively and any and all combinations or any two or more of the steps or features.

Each document, reference, patent application or patent cited in this text is expressly incorporated herein in their entirety by reference, which means that it should be read and considered by the reader as part of this text. That the document, reference, patent application or patent cited in this text is not repeated in this text is merely for reasons of conciseness. None of the cited material or the information contained in that material should, however be understood to be common general knowledge.

The present invention is not to be limited in scope by any of the specific embodiments described herein. These embodiments are intended for the purpose of exemplification only. Functionally equivalent products and methods are clearly within the scope of the invention as described herein.

The invention described herein may include one or more range of values (e.g. size etc). A range of values will be understood to include all values within the range, including the values defining the range, and values adjacent to the range which lead to the same or substantially the same outcome as the values immediately adjacent to that value which defines the boundary to the range.

Throughout this specification, unless the context requires otherwise, the word "comprise" or variations such as "comprises" or "comprising", will be understood to imply the inclusion of a stated integer or group of integers but not the exclusion of any other integer or group of integers.

Other definitions for selected terms used herein may be found within the detailed description of the invention and apply throughout. Unless otherwise defined, all technical terms used herein have the same meaning as commonly understood to one of ordinary skill in the art to which the invention belongs.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

DESCRIPTION OF THE PREFERRED EMBODIMENTS

Part of subsea tree, generally indicated by the numeral 8, according to an embodiment of a first aspect of the present invention is shown in FIG. 1. The part of the subsea tree 8 is the upper most part and includes a fluid swivel 10 mounted thereon. At its lower end (not shown) the subsea tree is adapted to be operably connected to a subsea well.

The fluid swivel 10 includes a fixed inner body in the form of a first ring member 12 located outside of the mandrel 14 and defines an inlet 16 in fluid communication with the production conduit 18 via a number of flow controllers in the form of valves 20*a-d* that control the flow of fluids, such as hydrocarbons, from the subsea well (not shown). The mandrel 14 further comprises a cap 32.

The fluid swivel 10 also includes a rotatable outer body in the form of a second ring member 22 that rotates around the first ring member 12 and includes an attachment point for the riser 26 in the form of a connector 28 that extends out from the second ring member 22. The connector 28 defines an outlet 24 for fluid communication with, and an attachment point for, the riser 26.

The fluid swivel 10 also defines a first interface in the form of the point of contact 34 of the opposed surfaces of the first 12 and second 22 ring members. In this regard, the point of contact 34 includes a bearing surface to allow for the second ring member 22 to rotate relative to the first ring member 12. The shape of the said opposed surfaces defines a fluid chamber in the form of fluid conduit 30 that has a generally circular cross section and extends around the outside of the mandrel 14 to define a generally circular flow path that is in fluid communication with the inlet 16 and outlet 24.

The main axis of the point of contact 34 between the first 12 and second 22 ring members is set on angle between 30° and 60° and includes a first seal in the form of fluid seal that allows for the second ring member 22 to rotate relative to the first ring member 12 without the loss of fluid from the subsea tree. The fluid seal 3 comprises a plurality of seals and bearings (best depicted in FIG. 2*a*) designed to suit the operational requirements of the subsea tree 8 including the forces applied to the fluid swivel 10 by movement and buoyancy of the riser 26, when in use. FIG. 2*b* (see below) shows an arrangement where the main axis of the point of contact between the first and second ring members is on an angle such as an angle between 30 and 60, 40 and 50, 42-48 or 45 degrees.

The riser 26 can be connected at its upper most end to a surface vessel (not shown) and, in use, the riser 26 is capable of rotation around the subsea tree 8. This allows for the surface vessel to weathervane without adversely impacting on the subsea tree, its connections and the operation of the well.

Figure 2A:
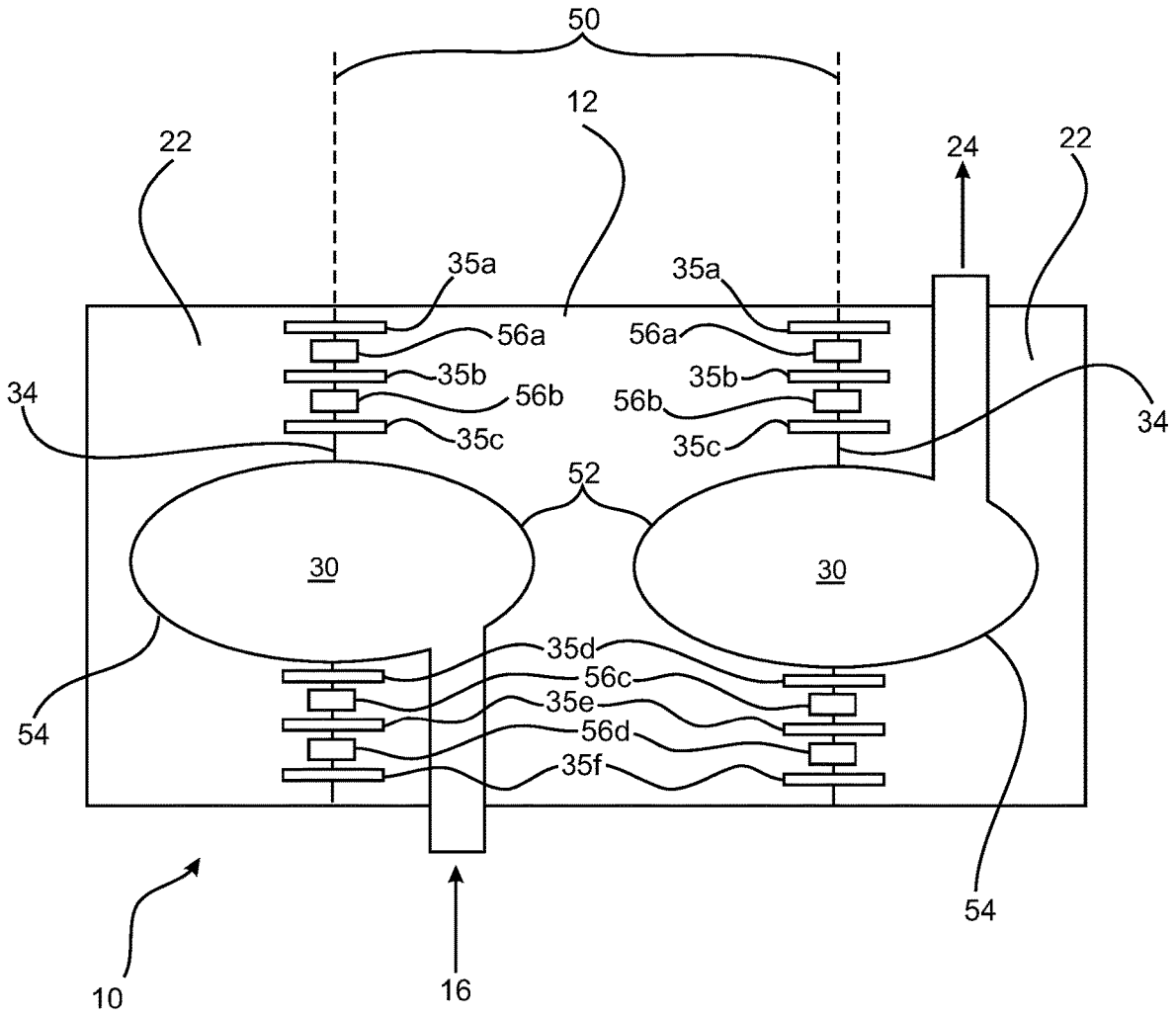
FIGS. 2*a* and 2*b* are schematics drawings of fluid swivels that form part of two different embodiments of the subsea tree according to the first aspect of the present invention.
Figure 2B:
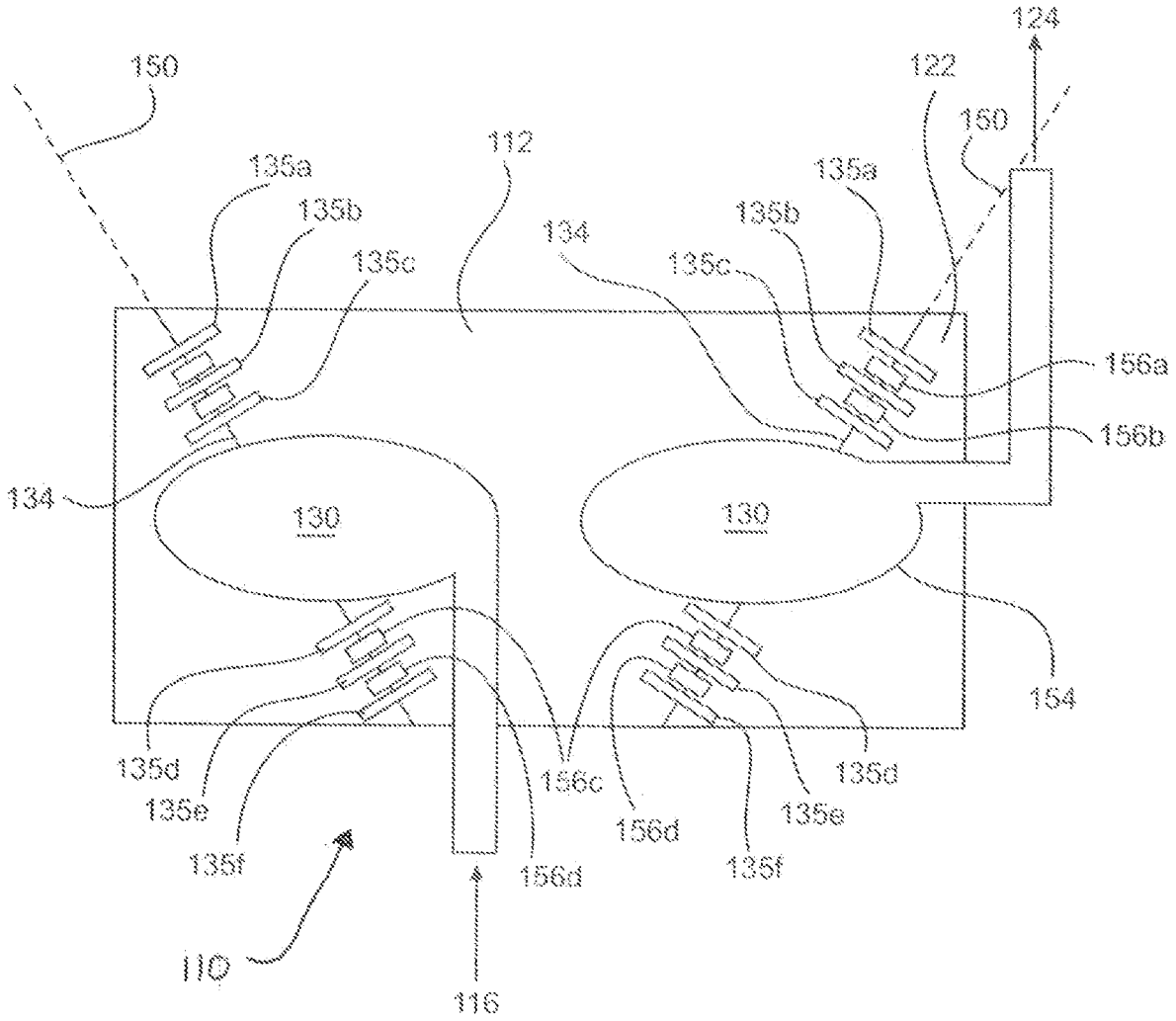

FIG. 2*a* is a schematic representation of a cross-sectional view of the fluid swivel 10 of FIG. 1. Features in FIG. 2*a* that correspond to features in FIG. 1 have been numbered consistently. The broken lines 50 in FIG. 2*a* delineate the main axis of the point of contact 34, which in this case has a generally vertical orientation, between the first ring member 12 and the second ring member 22.

The fluid swivel 10 comprises the fluid conduit 30 defined by the shape of the opposed surfaces of the first 12 and second 22 ring members in the form of a portion 52 of the outer wall of the stationery first ring member 12, and a portion 54 of the inner wall of the rotating second ring member 22.

The first seal is in the form of a fluid seal 35 which comprises a plurality of seals 35*a-f* and these are interspersed with bearings 56*a-d*. The bearings 56*a-d* and seals 35*a-f* enable rotation of the second ring member 22 without loss of fluid loss therebetween, when the fluid swivel 10 is attached to the riser 26 and the riser 26 is attached to a vessel that is weather vaning around the subsea tree 8. The number of seals and bearings and the arrangement of seal members and bearings may be adjusted to suit operational requirements.

FIG. 2*b* is a schematic representation of a cross-sectional view of an alternative fluid swivel 100 that forms part of another embodiment of a subsea tree according to the first aspect of the invention. Features in FIG. 2*b* that correspond to features in FIG. 2*a* have been numbered consistently save for the addition of the number 1 at the leading end of the reference numeral. The main difference between the fluid swivel 10 in FIG. 2*a* and the fluid swivel 110 in FIG. 2*b* is angle of the main axis 150 of the point of contact 134, which in this case is an oriented at an angle to the vertical.

The broken lines 150 in FIG. 2*b* delineate the main axis of the point of contact 134, which in the case of the swivel 110 is oriented at an angle to the vertical, between the first ring member 112 and the second ring member 122, resulting in a first ring member 112 defining an angular or tapered outer surface and the inner surface of the second ring member 122 being shaped to receive the first ring member 112 therein. Preferably, the fluid swivel 110 in the embodiment in FIG. 2*b* is better able to bear any forces, such as axial forces, imparted by a riser attached thereto.

Figure 3:
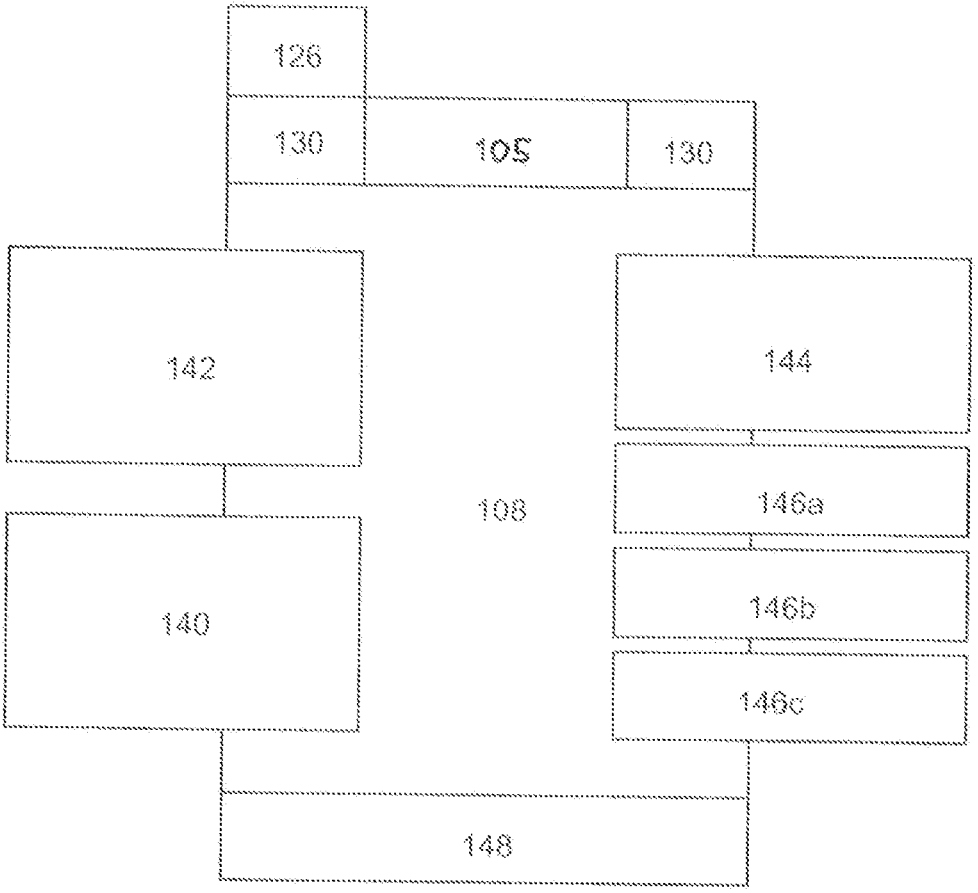
FIG. 3 is a schematic block diagram of a subsea tree according to another preferred embodiment of the present invention.

A subsea tree according to another embodiment of the first aspect of the present invention is schematically represented in FIG. 3 as a block diagram and generally indicated by the numeral 108 and is for use with a subsea well (not shown). The subsea tree 108 comprises a tree frame, and a tree block mounted to the tree frame. The tree block is mounted to a wellhead connector 148. A series of flow control valves are mounted to the tree block. The flow control valves can be manually operable, or remotely operable, or a combination of both. The tree block also comprises one or more ports to permit the transfer of hydraulic fluids, chemicals and electrical services to the subsea tree. The subsea tree 108 is further provided with remotely controlled injection valves (not shown) mounted to the tree block, for providing flow assurance chemicals to the subsea tree 108.

A fluid swivel 105 is mounted to an upper portion of the subsea tree 108, the fluid swivel 105 being attached to a lower end of a riser 126. The riser 126 is attached at an upper end to a surface vessel (not shown). The riser 126 is capable of rotational movement around the fluid swivel 105, and thereby is capable of rotational movement around the subsea tree 108.

In use, the fluid swivel 105 is in fluid communication with a production conduit (not shown) of the subsea well, and comprises (i) an inlet (not shown) for receiving one or more hydrocarbons from the production conduit, (ii) an outlet (not shown) for passing the one or more hydrocarbons to the riser 126, and (iii) a fluid flow passage 130 provided therebetween which allows fluid communication between the production conduit of the subsea well and the riser 126.

A subsea control module 142 is mounted to the tree block for remote actuation of the flow valves. The subsea control module 142 further comprises monitoring means, for monitoring parameters such as pressure and temperature. The subsea tree 108 further comprises a subsea hydraulic power unit (HPU) 140. Preferably, both the HPU 140 and the subsea control module 142 are removable. In addition, the subsea tree 108 comprises a hydraulic reservoir 144 adapted to receive fluid from a Remotely Operated Vehicle (ROV).

The subsea tree 108 is further provided with remotely controlled injection valves mounted to the tree block, for providing flow assurance chemicals to the subsea tree. Flow assurance chemicals are provided by chemical storage tanks 146*a-c* mounted to the tree block. The chemical storage tanks 146*a-c* are configured to be refilled by the ROV and can store chemicals such as scale inhibitor, corrosion inhibitor and methanol or MEG.

Figure 4:
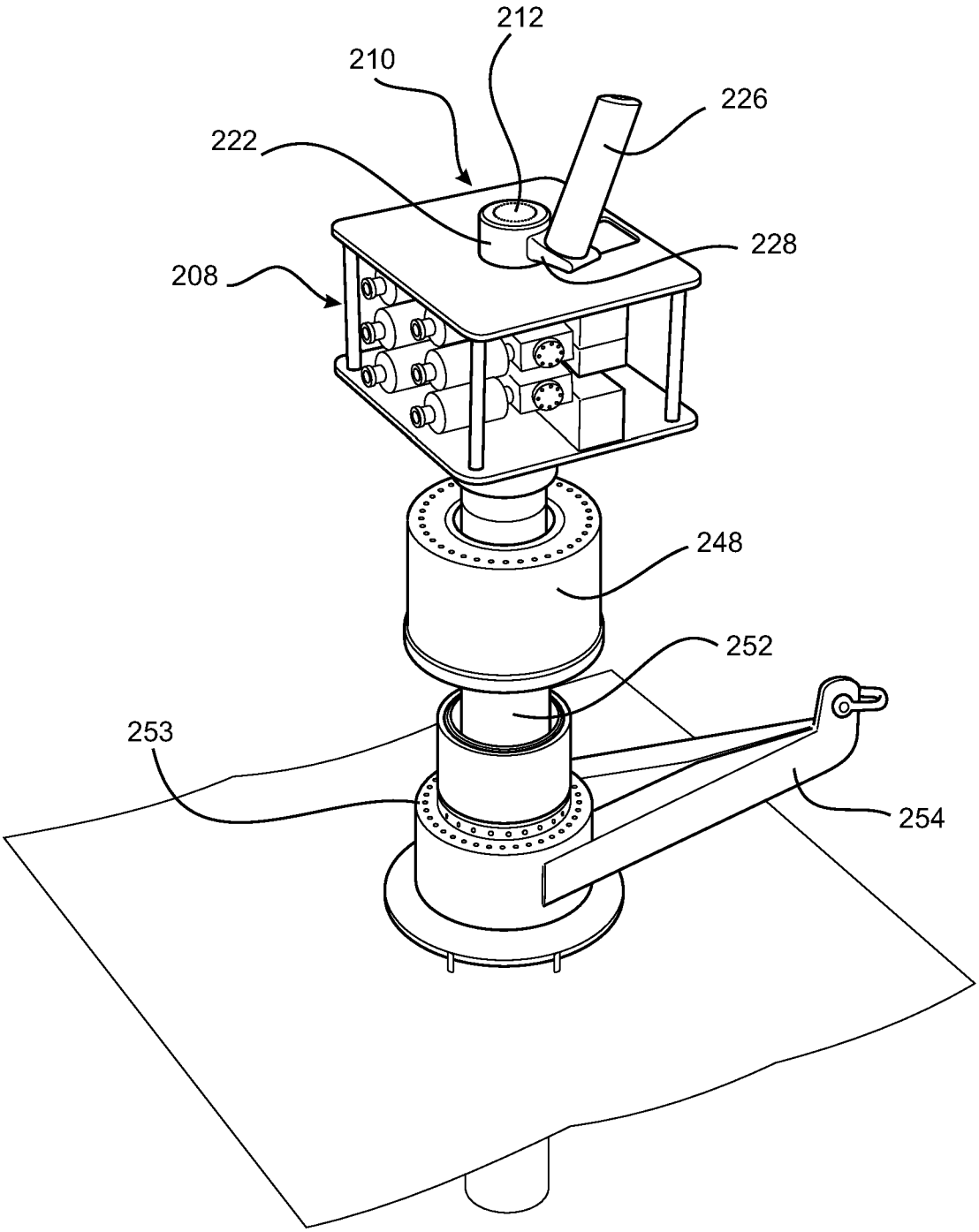
FIG. 4 illustrates a subsea tree according to another embodiment of the first aspect of the present invention, fitted to a well head and including a mooring assembly.

FIG. 4 shows a subsea tree according to another embodiment of the first aspect of the present invention, generally indicated by the numeral 208, as part of a system according to one embodiment of a second aspect of the present invention. The upper part of the subsea tree 208 includes a fluid swivel 210 mounted thereon.

The fluid swivel 210 is in fluid communication with the production conduit (not shown) and includes a rotatable outer body in the form of a second ring member 222 that rotates around the first ring member 212 and includes an attachment point for the riser 226 in the form of a connector 228 that extends out from the second ring member 222.

The subsea tree in FIG. 4 operates generally in the same manner as the subsea tree depicted in FIG. 1. The riser 226 can be connected at its upper most end to a surface vessel (not shown) and, in use, the riser 226 is capable of rotation around the subsea tree 208. At its lower end the subsea tree 208 is operably connected to a subsea well via a well head connector 248 that is in turn connected to a well head 252. Adjacent to the sea bed is a mooring assembly mounted on the well conductor in the form of rotatable housing 253 that includes a connector in the form of a mooring hawser 254 for a mooring line from a vessel. When attached to the hawser 254 a vessel is able to weather vane around the subsea well without adversely impacting on the subsea tree, its connections and the operation of the well.

Advantages, in use, of the present invention including one or more of:

(i) infrastructure is reduced leading to relatively low CAPEX e.g. by locating the chemicals and HPU on the subsea tree, the need for a multi-bore umbilical is removed, saving cost and reducing complexity of the surface facilities;

(ii) relatively small surface vessel and infrastructure reduces OPEX;

(iii) a wider range of surface vessels can be deployed for harvesting;

(iv) system can be used to target hydrocarbon resources with relatively short production lives;

(v) system is modular and components can be reused and redeployed and/or individually serviced or replaced;

(vi) reduced infrastructure footprint reduces the environmental impact.

The invention claimed is:

1. A subsea tree including:

(a) a fluid swivel comprising:

(i) a fixed inner body defining an inlet for fluid communication with a production conduit for a subsea well;

(ii) a rotatable outer body defining an outlet for fluid communication with a riser and an attachment point for the riser;

(iii) a first interface between the fixed inner body and the rotatable outer body defining a fluid chamber in fluid communication with the inlet and the outlet; and (iv) a first seal between the fixed inner body and the rotatable outer body; wherein, when the fluid swivel is attached to the riser, the riser is capable of rotational movement around the subsea tree;

(b) a hydraulic reservoir, a chemical reservoir, or both; and (c) a mooring assembly attached to the subsea well, wherein the mooring assembly is capable of rotational movement around the subsea well and independently of the fluid swivel.

2. The subsea tree according to claim 1, wherein the hydraulic reservoir comprises an inlet for receiving a hydraulic fluid.

3. The subsea tree according to claim 1, further comprising a hydraulic power unit (HPU) for controlling the flow of a hydraulic fluid from the hydraulic reservoir.

4. The subsea tree according to claim 3, wherein said inlet is adapted to be operable by a remotely operated vehicle (ROV).

5. The subsea tree according to claim 3, wherein the HPU is removable.

6. The subsea tree according to claim 1, wherein the chemical reservoir further comprises a chemical injection valve.

7. The subsea tree according to claim 6, wherein the chemical injection valve is operable by a ROV.

8. The subsea tree according to claim 1, further comprising (a) a subsea control module for remote actuation of the subsea tree, (b) monitoring parameters such as pressure and temperature, or both (a) and (b).

9. The subsea tree according to claim 8, wherein the subsea control module is removable.

10. The subsea tree according to claim 1, wherein the fluid swivel is operable by a hydraulic fluid from the hydraulic reservoir.

11. The subsea tree according to claim 1, wherein the fixed inner body is generally ring shaped.

12. The subsea tree according to claim 1, wherein the fixed inner body is generally cone shaped.

13. The subsea tree according to claim 12, wherein the generally cone shaped fixed inner body tapers in towards its lower end, when in use.

14. The subsea tree according to claim 1, wherein the fixed inner body is a blunt ended cone shape.

15. The subsea tree according to claim 1, wherein the outlet for fluid communication with a riser is located on the outer surface of the rotatable outer body.

16. The subsea tree according to claim 1, wherein the first interface comprises a point or surface where the rotatable outer body bears on the fixed inner body.

17. The subsea tree according to claim 1, wherein the first interface comprises a bearing or a plurality of bearings.

18. A system for harvesting a hydrocarbon from a subsea well, the system comprising:

(a) a subsea tree according to claim 1, operably connected to the subsea well;

(b) a surface vessel for harvesting the hydrocarbon; and (c) a riser having a first and a second end, said first end attached to and in fluid communication with the fluid swivel, and said second end attached to and in fluid communication with the surface vessel;

wherein, in use, the surface vessel is capable of rotational movement around the subsea well.

19. The system according to claim 18, wherein the mooring assembly is located at or near the interface between the subsea well and a subsea ground surface.

20. The system according to claim 19, wherein the mooring assembly comprises a housing for a well conductor.

21. The system according to claim 20, wherein the mooring assembly is mounted to the well conductor.

22. The subsea tree according to claim 1, wherein the mooring assembly is located at or near an interface between the subsea well and the subsea ground surface.

23. The subsea tree according to claim 1, wherein the mooring assembly comprises a housing for a well conductor.

* * * * *